United States Patent [19]

Vezirian

[11] 4,325,439

[45] Apr. 20, 1982

[54] DIAMOND INSERT STUD FOR A DRAG BIT

[75] Inventor: Edward Vezirian, Fountain Valley, Calif.

[73] Assignee: Smith International, Inc., Newport Beach, Calif.

[21] Appl. No.: 35,371

[22] Filed: May 2, 1979

[51] Int. Cl.[3] ..... E21B 9/36; E21C 13/01

[52] U.S. Cl. ..... 175/329; 175/410

[58] Field of Search ..... 175/329, 330, 374, 410; 76/108 R; 29/525

[56] References Cited

U.S. PATENT DOCUMENTS

| | | | |
|---|---|---|---|
| 1,041,568 | 10/1912 | Bade | 175/410 X |
| 1,388,490 | 8/1921 | Suman | 175/393 X |
| 1,506,119 | 8/1924 | Hansen | 175/329 X |
| 3,599,737 | 8/1971 | Fischer | 175/374 |
| 3,852,874 | 12/1974 | Pearson | 175/410 X |
| 3,858,671 | 1/1975 | Kita et al. | 175/410 |
| 4,006,788 | 2/1977 | Garner | 175/330 |
| 4,109,737 | 8/1978 | Bovenkerk | 175/410 X |
| 4,168,923 | 9/1979 | Vezirian | 175/410 X |
| 4,199,035 | 4/1980 | Thompson | 175/410 |

*Primary Examiner*—James A. Leppink

*Attorney, Agent, or Firm*—Robert G. Upton

[57] ABSTRACT

A circumferential shoulder or boss is provided on a diamond insert cutter stud to facilitate insertion of the stud into a pre-drilled insert hole formed in a drag bit body. A special tool slips over the diamond tip of the stud and contacts the boss for insertion of the stud into the insert hole without damage to the synthetic diamond blank bonded to the top of the stud.

2 Claims, 5 Drawing Figures

DIAMOND INSERT STUD FOR A DRAG BIT

BACKGROUND OF THE INVENTION

1. Field of the Invention

This invention relates to diamond insert drag bits.

More particularly, this invention relates to diamond faced insert studs and a method to press these studs into insert holes formed in the face of a drag bit body without damage to the diamond cutting tip of the studs.

2. Description of the Prior Art

Conventional synthetic diamond blanks typically are cemented, brazed, or sintered to an insert stud. The diamond layer is generally composed of a polycrystalline material joined to a substrate layer of tungsten carbide material. A synthetic diamond blank of the above description, for example, is manufactured by the Specialty Material Department of General Electric Company of Worthington, Ohio. The synthetic diamond blank goes by the trademark name of Stratapax drill blanks. The Stratapax blanks are typically brazed to the top extended portion of the studs. The blanks are brazed to the studs with about a 20° angle of the diamond face relative to the axis of the body of the insert stud. State of the art stud insertion practice often damaged or destroyed this type of insert by attempting to drive the stud into its respective hole by pressing on the angled top surface of the cutting end of the stud. The stud hole in the drag bit is drilled to provide an interference fit, therefore, considerable force is exerted on the tip of the stud more often than not, resulting in damage to the synthetic polycrystalline layer. Since the diamond studs are very expensive, a more satisfactory method was urgently sought to cut down on diamond insert losses.

The present invention incorporates a ledge, boss or shoulder between the base of the stud and the cutting face of the blank brazed to the stud to provide a datum surface for a specially designed tool to hydraulically press the studs into the holes formed in the face of the drag bit.

This invention provides a diamond insert configuration for use with, for example, steel bodied drag bit designs having substantial cutter stand-off which has adequate strength to withstand drilling forces and can be easily attached to the bit body by interference fitting without damaging the stud or attached diamond cutter blank while maintaining alignment of the stud in the process.

SUMMARY OF THE INVENTION

It is an object of this invention to provide a means to install diamond insert studs into the face of a drag bit body.

More particularly, it is an object of this invention to provide a radially extending circumferential boss or shoulder on the body of the studs to accommodate the contact surface of a special diamond insert insertion tool. The tool assures protection of the diamond tip and proper alignment of the stud with the hole in the face of the drag bit while the stud is driven or hydraulically pressed into the interference fit hole.

A man-made diamond insert stud is modified for easier installation of the stud into the face of a diamond drag bit. The stud consists of a cylindrical, solid body having a first cutter end and a second base end with a circumferential shoulder substantially 90° to an axis of said stud formed in the cylindrical body. The shoulder, or boss, is positioned between the first cutter end and the second base end of the body. The shoulder circumferentially extends beyond any portion of the first cutter end and substantially encircles the tip end of the stud. The shoulder serves to provide a contact and datum surface for stud alignment and insertion by insert insertion means into an interference fit stud insert hole formed in the face of the diamond drag bit.

Each of the studs additionally have either an axially aligned male key protrusion on the extended portion of each stud or a female slot below the boss or shoulder formed in the stud. A special cylindrically shaped tool fits over the cutting end of the inserts, the bottom lip of the tool mates with the datum surface shoulder, or boss, of the studs. A slot or male protrusion formed in the tool matches with the slot or protrusion in the stud body to align the cutting face of the insert with respect to the desired position of the stud in the face of the drag bit to maximize the cutting action of each stud in a borehole. The tool then is chucked into a hydraulic press and the studs are subsequently driven into the aligned interference fit stud hole in the drag bit face. The special tool then, when engaged with the shoulder of the stud, eliminates the chance of damage to the expensive synthetic diamond cutting tip of the insert.

Moreover, the base of the tool aligns correctly, each stud with its respective hole in the drag bit face, thus preventing damage to the drag bit body due to misaligned stud bodies, especially where 100 to 7,000 pounds of hydraulic pressure is required to engage each stud with the drag bit body. The insertion force required is dependent on the amount of interference fit desired.

An advantage then over conventional synthetic diamond studs is the shoulder formed in each stud body to accommodate an insert tool to engage each stud with its respective insert hole formed in the face of the drag bit without damage either to the expensive synthetic diamond stud or to the bit body.

The above noted objects and advantages of the present invention will be more fully understood upon a study of the following detailed description in conjunction with the detailed drawings.

DESCRIPTION OF THE PREFERRED EMBODIMENTS AND BEST MODE FOR CARRYING OUT THE INVENTION

Figure 1:
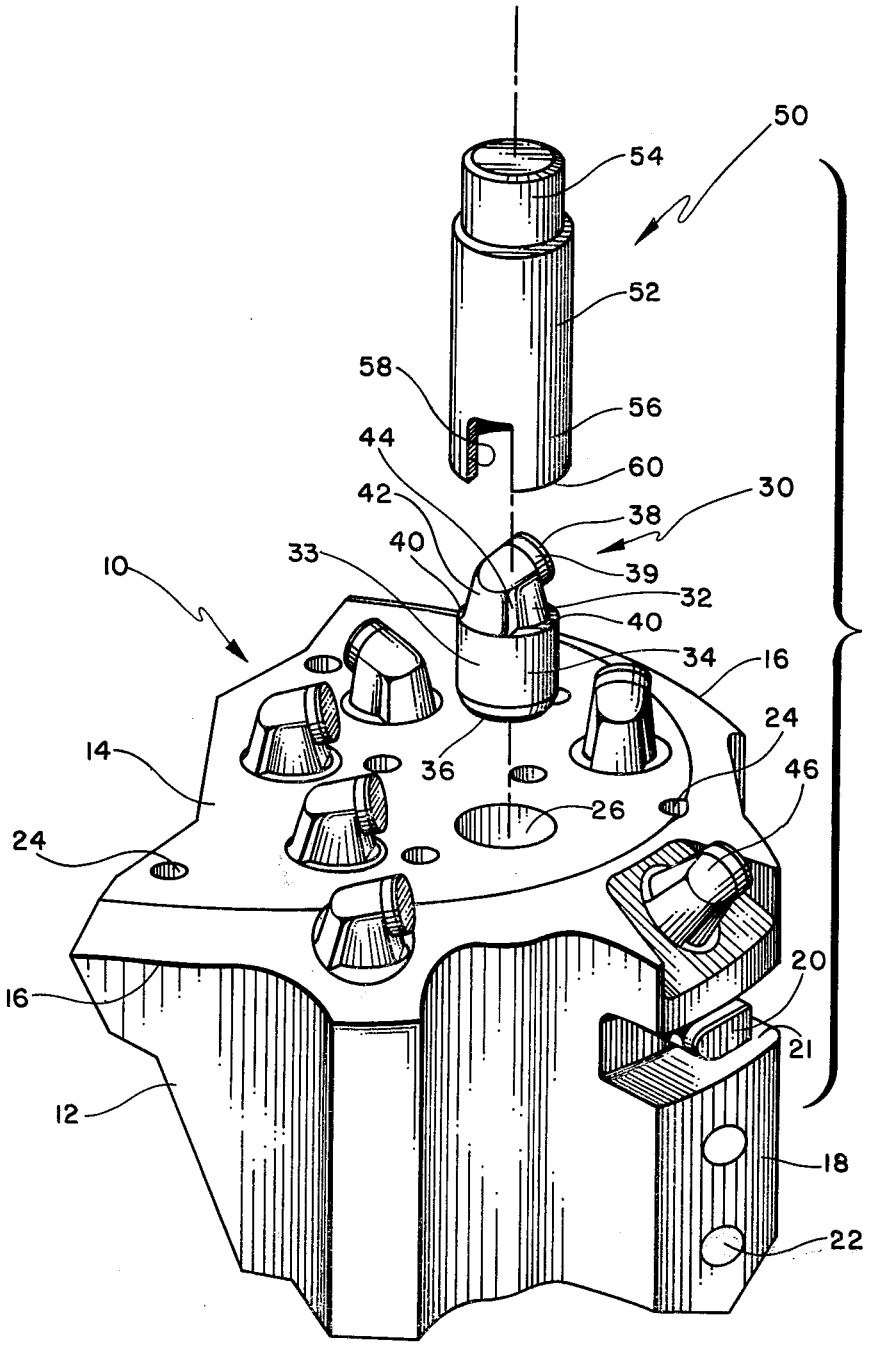
FIG. 1 is a partially broken-away, exploded perspective view of a diamond drag bit.

Referring to FIG. 1, the diamond insert drag bit, generally designated as 10, consists of drag bit body 12 which defines a bit face 14. A series of hydraulic passages 24 are drilled in face 14 of bit body 12. Each hydraulic passage communicates with an interior chamber formed by the bit body 12 (not shown). In addition, a series of insert holes 26 are drilled in face 14. Each insert hole 26 is drilled to provide an interference fit for each of the diamond studs, generally designated as 30. A multiplicity of diamond studs 30 are strategically placed in face 14 of the bit body 12 and each hydraulic passage is so positioned to provide coolant and cleaning of each of the studs 30.

The bit body 12 defines a series of axially aligned stabilizer bosses 18. Each boss has a series of tungsten carbide inserts 22 that are mounted flush with the surface of the stabilizer boss 18. A section 21 is cut in each stabilizer boss just below the peripheral edge 16 of face 14. In this cutout section 21 is placed a series of stud gage trimmers 20, designed to trim the gage of the hole as the drag bit is advanced in the borehole. Positioned around the peripheral edge 16 is a series of diamond face gage inserts 46. These studs are cantilevered outwardly to cut the gage of the borehole.

Each of the diamond insert studs 30 is comprised of an upper portion 32 that extends from the lower portion 33 of the stud 30. The bottom portion 33 defines grip length 34 of stud 30. The base 36 of the stud is chamfered to serve as a centering guide as the stud is inserted into the hole 26 of bit body 12. A polycrystalline disc or blank 38 is brazed to the upper stud portion 32, the synthetic diamond 38 being at an angle of approximately 20° with respect to the axis of the stud 30. Between the extended portion 32 and the lower portion 33 is defined a shoulder, ledge or boss 40. The surface of ledge 40 is oriented perpendicular to the axis of the stud 30. The outer diameter of the cylindrical lower body 33 extends beyond any surface defined by the extended portion 32. A male insertion alignment key 42 is formed by upper portion 32 and positioned generally opposite the diamond disc 38. The male key 42 serves as a means to align the cutting surface of disc 38 with reference to face 14 of drag bit body 12.

A stud insertion tool, generally designated as 50, is comprised of a body 52 which defines, at one end, an arbor attachment sleeve 54 and, at its opposite end, a cylindrical base 56. Base 56 defines a female alignment slot 58 which, when the insertion tool is slipped over the extended end 32, including the diamond disc 38, the sides of the slot 58 engage with the surfaces 44, defined by the male insertion alignment key 42. Thus, it is clearly evident that while the bottom lip 60 is in contact with shoulder, or boss, 40, the alignment slot 58 is extended over the male key 42 so that the tool axially aligns each of the blanks 30 with respect to the stud hole 26 while simultaneously aligning the studs 30 with respect to the surface 14 of the drag bit.

The insertion tool, for example, is designed to be chucked at end 54 within an arbor of a hydraulic press machine (not shown). It would be obvious to drive the studs within their interference fit holes with a hammer without damage to the stand-off cutting end 32 of the diamond insert studs 30. Since the base 33 of the studs 30 is larger in diameter than the top or stand-off portion 32, a ledge 40 is provided between the base and top portions around at least two-thirds of the stud diameter. With the use of a pressing tool or arbor of the proper configuration, pressure can be applied uniformly around the ledge 40 without loading the diamond disc 38. The configuration shown in FIGS. 1, 2 and 3 also constrains the insert stud 30 from rotating, and balances the pressing forces around the vertical axis of the stud to prevent cocking during the interference fitting operation into drag bit body 12. Another advantage of keeping the top 32 of the stud 30 within the diameter of the base portion 33 is to minimize the amount of counterboring necessary for clearance of the stud if the stud is to be seated in a hole deeper than the depth of the base 36 for reduced stand-off distance from the face 14 and the bottom of the borehole. This feature is particularly important if the stud axis is not oriented vertical to the tangent of the bit face 14.

Figure 2:
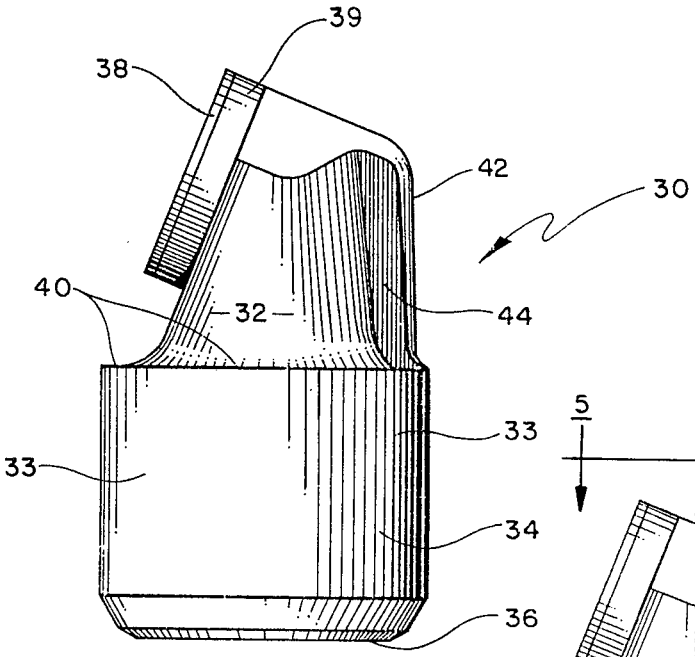
FIG. 2 is a side elevational view of a synthetic diamond stud.

FIG. 2 is a side elevational view of the diamond insert stud 30. This view clearly shows the shoulder, ledge or boss portion 40 approximately midway between the base 36 and the tip of the cutting disc 38, mounted to stand-off portion 32. The male alignment boss 42 has defined thereon surfaces 44 for engagement with the insertion tool 50 as shown in FIG. 1.

Figure 3:
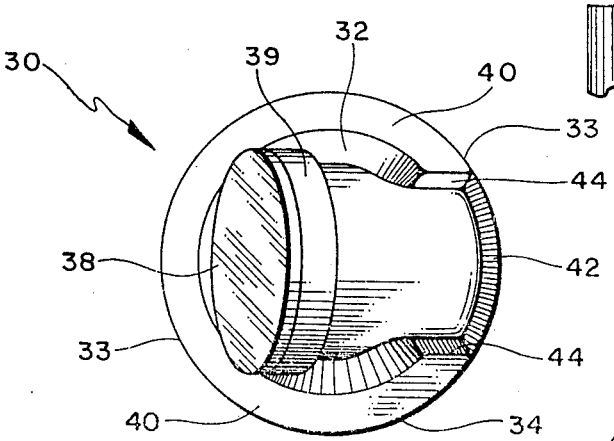
FIG. 3 is a top view of the stud of FIG. 2.

FIG. 3 illustrates shoulder 40 which clearly extends beyond any portion of extended portion 32 so that as the insertion tool 50 is slipped over the top of the stud 30, there can be no damage to the expensive diamond disc 38. Instead of having a male alignment boss 42 on the stud, the alignment means could be a female slot formed in the stud which extends below the datum shoulder or boss 40. A male extension is then formed on the lip 60 of the tool 50 to be inserted within the female slot in the desired insert stud 30.

Figure 4:
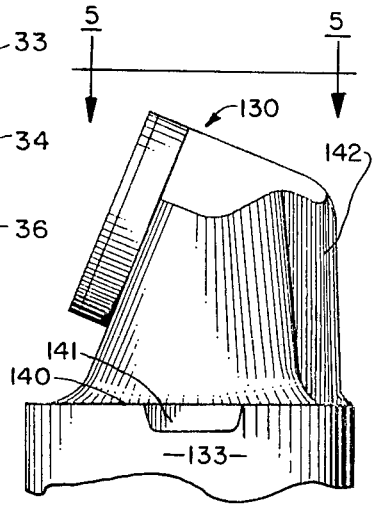
FIG. 4 is a partially broken-away side elevational view of an alternative embodiment of the present invention.

FIG. 4 is a view illustrating a female slot 141 formed in base 140 of insert 130. The female slot 141 could be used to align the insert relative to the face 14 of the drag bit 10. The male alignment boss 142 could then be eliminated from the insert 130.

Figure 5:
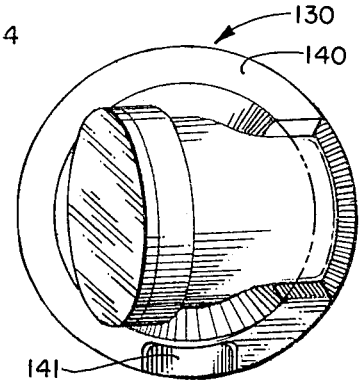
FIG. 5 is a view taken through 5—5 of FIG. 4.

FIG. 5 more clearly illustrates the female slot 141 in ledge or boss portion 140. The ledge 140 could then continue 360 ° around the insert 130 as shown in phantom line in FIG. 5. Obviously the substantially 360 ° ledge 140 would provide more surface for the insert insertion tool when the inserts are pressed into insert holes formed in face 14 of drag bit 10 (FIG. 1).

It will of course be realized that various modifications can be made in the design and operation of the present invention without departing from the spirit thereof. Thus, while the principal preferred construction, and mode of operation of the invention have been explained in what is now considered to represent its best embodiments has been illustrated and described, it should be understood that within the scope of the appended claims, the invention may be practiced otherwise than as specifically illustrated and described.

I claim:

1. A man-made diamond insert stud for a diamond drag bit, said drag bit having a multiplicity of said studs extending from the face of said bit, said stud comprising:

a substantially cylindrical solid insert stud body having a first cutter end and a second base end, and a circumferential, radially extending shoulder substantially 90° to an axis of said stud is formed in said cylindrical body positioned between said first cutter end and said second base end of said body, said shoulder radially extends beyond any portion of said first cutter end and substantially encircles said cutter end, said shoulder, integral with said stud, serves to provide a contact and datum surface for insert stud alignment and insertion means so that said stud may be inserted in said face of said drag bit without damage to said first cutter end of said insert stud body, said stud body further including an axially aligned female slot formed in said cylindrical body in said radially extending circumferential shoulder between said shoulder and said second base end of said stud, said slot serves as an alignment guide for said stud insertion means.

2. The invention as set forth in claim 1 further including an axially aligned male key substantially opposite a synthetic diamond cutter disc joined at said first cutter end of said cylindrical body, said key serves as an alignment guide for said stud insertion means.

* * * * *